US005662275A

United States Patent [19]

Lambert

[11] Patent Number: 5,662,275

[45] Date of Patent: Sep. 2, 1997

[54] FUEL INJECTION NOZZLE

[75] Inventor: Malcolm Lambert, London, Great Britain

[73] Assignee: Lucas Industries Public Limited Company, Solihull, England

[21] Appl. No.: 495,648

[22] PCT Filed: Jan. 28, 1994

[86] PCT No.: PCT/GB94/00169

§ 371 Date: Sep. 13, 1995

§ 102(e) Date: Sep. 13, 1995

[87] PCT Pub. No.: WO94/17300

PCT Pub. Date: Aug. 4, 1994

[30] Foreign Application Priority Data

Jan. 29, 1993 [GB] United Kingdom ..... 9301793

[51] Int. Cl.[6] ..... F02M 61/08

[52] U.S. Cl. ..... 239/533.6; 239/533.7; 239/533.9

[58] Field of Search ..... 239/533.1–533.3, 239/533.6, 533.7, 533.9, 533.12

[56] References Cited

U.S. PATENT DOCUMENTS 4,730,785 3/1988 Seifert ..... 239/533.3 X

FOREIGN PATENT DOCUMENTS

| | | | |
|---|---|---|---|
| 921 787 | 11/1945 | France . | |
| 1 139 698 | 11/1962 | Germany . | |
| 31 39 170 | 4/1983 | Germany . | |
| 31 39 288 | 4/1983 | Germany . | |
| 586 213 | 3/1947 | United Kingdom . | |
| 2 054 033 | 2/1981 | United Kingdom . | |
| 2 058 915 | 4/1981 | United Kingdom . | |
| 2097058 | 10/1982 | United Kingdom | 239/533.9 |

*Primary Examiner*—Lesley D. Morris
*Attorney, Agent, or Firm*—Jacobson, Price, Holman & Stern PLLC

[57] ABSTRACT

A fuel injection nozzle of the outwardly opening type has a valve member movable outwardly by the fuel pressure within a bore in a nozzle body. The member is biased to the closed position by an elastic member in the form of a rod. At its end remote from the valve head, the rod engages a collar between which and an adjacent part of the valve body is a shim. The thickness of the shim is selected so that the tension force in the rod is higher than is required to give the desired nozzle opening pressure and this is adjusted to the desired value by compressing a portion of the nozzle body using a cap nut which secures the nozzle body to a supporting part.

2 Claims, 1 Drawing Sheet

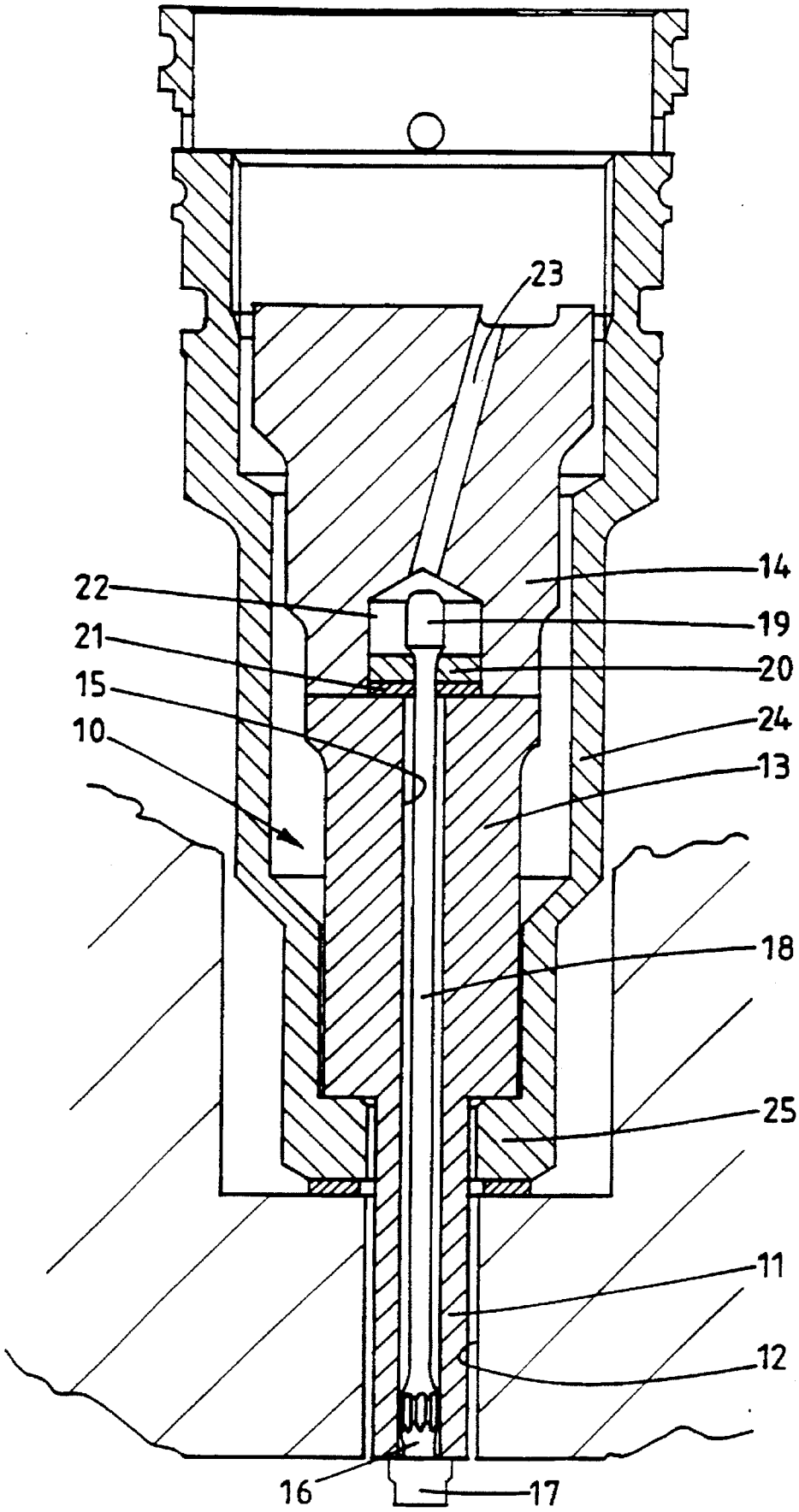
23
14
22
19
21
20
15
24
10
13
18
25
11
12
16
17

FUEL INJECTION NOZZLE

This invention relates to a fuel injection nozzle for supplying fuel to an internal combustion engine and of the kind comprising an elongated nozzle body, a bore extending axially between the ends of the body, a seating surface defined on the body at one end of the bore, a valve member movable in the bore, the valve member having a head for engagement with the seating surface, an elastic member coupled to the valve member, the elastic member extending within the bore and acting to bias the head of the valve member into engagement with the seating surface and means for admitting fuel under pressure into said bore, the arrangement being such that in use, when the fuel pressure in the bore attains a predetermined value the head of the valve member will be lifted from the seating surface to allow fuel flow from the one end of the bore to the associated engine, the end of the elastic member remote from the head being engaged with a collar between which and an adjacent portion of the nozzle body is located a shim.

Such nozzles are known in the art as outwardly opening nozzles and have important advantages over the more common inwardly opening nozzle. One advantage is that when the valve head is in contact with the seating surface no fuel can dribble from the nozzle. In the case of an inwardly opening nozzle there remains a volume of fuel downstream of the seating surface when the valve member is in contact with the seating surface and this volume of fuel can dribble from the nozzle and cause an increase in the hydrocarbon content of the engine exhaust.

An example of such a nozzle is seen in DE-A-3139170. In this case the thickness of the shim has to be selected so as to provide the desired nozzle opening pressure.

Another example of a nozzle is seen in FR-A-921787. The elastic member is in the form of a rod which at its end remote from the valve member is secured within a screw threaded bush. Engaged with the screw threads of the bush is a nut which also engages the adjacent end of the nozzle body and relative rotation of the bush and nut will vary the tension in the elastic member and thereby the pressure of fuel required to lift the valve member from the seating surface. GB-A-586213 shows another form of nozzle in which the end of the elastic member remote from the valve head is provided with a screw thread and is engaged by a nut whereby the tension in the elastic member can be varied. The use of screw threaded members to adjust the nozzle opening pressure has been found to be unsatisfactory for a number of reasons. Firstly the method of adjustment has to allow for coarse adjustment to take account of manufacturing tolerances but also fine adjustment to alter the tension in the elastic member. In order to provide the fine adjustment the screw threads have to have a low pitch and it has been proposed to achieve this by means of a differential nut. However, the space available is small and it is difficult to form the threads to the high degree of accuracy required. In addition the threads provide regions of high stress concentration.

The object of the present invention is to provide a fuel injection nozzle of the kind specified in a simple and convenient form.

According to the invention in a nozzle of the kind specified the head of the valve member is located beyond the one end of the bore and the thickness of the said shim being such as to generate a tension force in the elastic member in excess of that required to provide the desired nozzle opening pressure and means is provided for applying a compressive force to a part of said nozzle body to reduce the tension force in the elastic member.

An example of a fuel injection nozzle in accordance with the invention will now be described with reference to the accompanying drawing which shows the nozzle and parts associated therewith in sectional side elevation.

With reference to the drawing the nozzle comprises a nozzle body 10 of stepped cylindrical form. The body has a narrower portion 11 which extends in use through a bore 12 formed in the cylinder head of the associated engine, the bore 12 being an extension of a wider bore in the cylinder head. The wider portion 13 of the body flares outwardly by a small amount at its end remote from the narrower portion and the end surface of the wider portion is machined to form a fuel tight seal with the end surface of a spacer member 14.

Extending between the ends of the nozzle body is a cylindrical bore 15 and the end surface of the narrower portion 11 of the body surrounding the opening of the bore is machined to form a seating surface. Slidable within the adjacent end portion of the bore is a valve member 16 which has a head 17 located outside the bore and a fluted guide portion which cooperates with the wall of the bore. The under surface of the head is machined so as to cooperate with the seating surface to prevent escape of fuel from the bore. The valve member is located at one end of an elastic member in the form of a thin rod 18 which is integrally formed with the valve member. The rod extends with clearance through the bore and the end of the rod remote from the head projects beyond the end of the body and is enlarged to define an abutment 19 which is of a size such that it can be passed through bore 15.

The abutment 19 seats in a collar which is defined by a C-shaped washer 20 and between the washer and the adjacent end of the wider portion of the body is a shim 21 which is also of C-shaped form, the C-shaped form of both the washer and the shim allowing their location beneath the abutment. The washer, shim and abutment are located in a chamber 22 formed in the spacer member 14 and fuel under pressure can be supplied to the chamber through a passage 23 in the spacer member. By virtue of the C-shape of the washer and the shim, the bore 15 is in communication with the chamber.

The nozzle body 10 and the spacer member 14 are held in assembled relationship with a nozzle holder or with the housing of a fuel pump, by means of a cap nut 24 which has an apertured inwardly directed flange 25 engaged with the step defined between the two portions of the nozzle body. The cap nut at its open end is provided with an internal screw thread which is engaged with the holder or housing and tightened to draw the various components into sealing engagement.

In the use of the nozzle when fuel under pressure is supplied through the passage 23, the fuel pressure acts on the underside of the head 17 of the valve member and when the pressure attains a sufficiently high value the head will be lifted from the seating surface against the tension force in the rod 18. Fuel can now flow from the end of the bore into a combustion chamber of the associated engine, the fuel being atomized as it leaves the bore.

It is vital that the nozzle opening pressure should be capable of adjustment to a predetermined value and in order to achieve this during assembly of the nozzle a shim 21 is fitted between the washer 20 and the end of the body which applies a pre-load to the rod 18. The nozzle is then assembled to the holder or pump housing and the cap nut tightened and the nozzle is inserted in a jig which will reproduce the clamping force which is applied to the nozzle when it is inserted in the cylinder head of an engine. The nozzle is then tested and if the nozzle opening pressure proves to be too low a thicker shim is inserted and the nozzle opening pressure again checked.

With a shim in place which gives a nozzle opening pressure slightly higher than required, the nozzle opening pressure can be reduced by further tightening of the cap nut. This has the effect of increasing the compression force applied to the wider portion 13 of the nozzle body and thereby causing a reduction in its axial length thereby resulting in a lowering of the nozzle opening pressure as the pre-load in the rod 18 is reduced. Once the opening pressure has been correctly set in the jig, the holder or pump housing and nozzle can be removed from the jig and providing in use the same clamping force is applied, the desired nozzle opening pressure will be obtained.

I claim:

1. A fuel injection nozzle for supplying fuel to an internal combustion engine and comprising an elongated nozzle body (10), a bore (15) extending axially between the ends of the body, a seating surface defined on the body at one end of the bore, a valve member (16) movable in the bore and having a head (17) for engagement with the seating surface, an elastic member (18) coupled to the valve member, the elastic member extending within the bore and acting to bias the head (17) of the valve member into engagement with the seating surface, means (23) for admitting fuel under pressure into said bore whereby when the fuel pressure attains a predetermined value the head (17) will be lifted from the seating surface to allow fuel flow from one end of the bore to the associated engine, the end of the elastic member (18) remote from the head (17) being engaged with a collar (20) between which and an adjacent portion of the nozzle body (10) is located a shim (21), wherein the head (17) is located beyond the one end of the bore (15) and the thickness of the shim being such as to generate a tension force in the elastic member (18) in excess of that required to provide the desired nozzle opening pressure and means (24, 25) for applying a compressive force to a part of said nozzle body (10) to reduce the tension force in the elastic member (18).

2. A nozzle according to claim 1, wherein said means for applying a compress force comprises a cap nut (24) which engages against a step defined on the nozzle body (10) and which is in screw thread engagement with a part mounting the nozzle body.

* * * * *